US008849179B2

(12) United States Patent
Sahara

(10) Patent No.: US 8,849,179 B2
(45) Date of Patent: Sep. 30, 2014

(54) IMAGE FORMING APPARATUS

(75) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 13/225,234

(22) Filed: Sep. 2, 2011

(65) Prior Publication Data

US 2012/0057893 A1 Mar. 8, 2012

(30) Foreign Application Priority Data

Sep. 8, 2010 (JP) ..... 2010-201083
Jun. 28, 2011 (JP) ..... 2011-143024

(51) Int. Cl.
*G03G 15/00* (2006.01)

(52) U.S. Cl.
CPC ..... *G03G 15/657* (2013.01)
USPC ..... 399/400; 271/227

(58) Field of Classification Search
USPC ..... 399/400
See application file for complete search history.

(56) References Cited

U.S. PATENT DOCUMENTS

| | | | | |
|---|---|---|---|---|
| 7,742,736 | B2 * | 6/2010 | Kobayashi et al. | 399/389 |
| 7,802,673 | B2 * | 9/2010 | Yasuda et al. | 198/813 |
| 2006/0222394 | A1 * | 10/2006 | Koshida | 399/68 |
| 2007/0025781 | A1 * | 2/2007 | Okuno et al. | 399/322 |
| 2007/0280763 | A1 * | 12/2007 | Suzuki | 399/394 |
| 2009/0067907 | A1 * | 3/2009 | Maddux et al. | 399/389 |

FOREIGN PATENT DOCUMENTS

| | | | | |
|---|---|---|---|---|
| JP | 03255304 | A * | 11/1991 | B65H 7/02 |
| JP | 05338859 | A * | 12/1993 | B65H 7/08 |
| JP | 08119534 | A * | 5/1996 | G03G 21/00 |
| JP | 08290849 | A * | 11/1996 | G03G 21/00 |
| JP | 10181891 | A * | 7/1998 | B65H 1/00 |
| JP | 11116097 | A * | 4/1999 | G03G 15/00 |
| JP | 11268843 | A * | 10/1999 | G03G 15/00 |
| JP | 2002-91226 | A | 3/2002 | |
| JP | 2005263402 | A * | 9/2005 | G03G 15/00 |
| JP | 2006341974 | A * | 12/2006 | G03G 15/00 |
| JP | 2007-52112 | A | 3/2007 | |
| JP | 2008-1447 | A | 1/2008 | |

* cited by examiner

*Primary Examiner* — Nguyen Ha
(74) *Attorney, Agent, or Firm* — Canon U.S.A., Inc., IP Division

(57) ABSTRACT

An image forming apparatus includes a transfer unit configured to transfer an image to a recording material, a fixing unit configured to fix, to the recording material, the image transferred to the recording material, a first curvature detection unit located between the transfer unit and the fixing unit and configured to adjust an amount of curvature of the recording material to a first amount of curvature, and a second curvature detection unit located between the transfer unit and the fixing unit and configured to adjust the amount of curvature of the recording material to a second amount of curvature, wherein the second curvature detection unit is located in a position different from the first curvature detection unit in a width direction orthogonal to a conveyance direction of the recording material.

11 Claims, 13 Drawing Sheets

--Prior Art--

--Prior Art--

IMAGE FORMING APPARATUS

BACKGROUND OF THE INVENTION

1. Field of the Invention

The present invention relates to an image forming apparatus using an electrostatic recording method, an electrophotographic recording method, or the like.

2. Description of the Related Art

As an image forming apparatus using an electrostatic recording method, an electrophotographic recording method, or the like, conventionally, an electrophotographic printer as illustrated in FIG. 8 has been used. Referring to FIG. 8, with respect to this conventional image forming apparatus, a basic configuration, a function, and the like will be described below.

First, the image forming apparatus includes a plurality of image forming units 10 each configured to form a latent image on a photosensitive drum 11 as an image bearing member using light, magnetism, electric charge, or the like, develop the latent image, and obtain a visible image; an intermediate transfer member 30 located above the image forming units 10 and configured to successively receive the visible image from each image forming unit 10 to form a multi-color image; a transfer unit 35 configured to transfer the multi-color image on the intermediate transfer member 30 to a recording material P; a paper feed unit 20 configured to convey the recording material P from a cassette to the transfer unit 35; and a fixing unit 40 configured to fix the multi-color image transferred on the recording material P in the transfer unit 35 to the recording material P.

As the fixing unit 40, a fixing unit of the film heating type for heating via a fixing film small in heat capacity is adopted as an on-demand method, where a heat transfer efficiency is high and the start-up of an apparatus is quick. This fixing unit of the film heating type will be described referring to FIG. 9. In the fixing unit 40, a fixing nip N is formed with a pressure roller 41 for applying the predetermined pressure and a heating unit 42. The heating unit 42 includes a film 43, a film guide 44, a heater 45, and a thermistor 46.

In the fixing unit of the above-described on-demand method, when a recording material small in size in a direction perpendicular to a paper pass direction (hereinafter, referred to as paper width direction) is fed, there has been a problem in which heat is left in a paper non-pass portion, through which the recording material does not pass, in the fixing nip N to increase the temperature of the paper non-pass portion. In a case where the temperature of the paper non-pass portion has become extremely high due to the passage of the small size recording material, when a large size recording material is fed directly after the small size recording material, since the temperature of the paper non-pass portion for the small size recording material is too high, a toner on the recording material may be deprived by a fixing film in a portion of the large size recording material corresponding to the paper non-pass portion for the small size recording material, so that an image defect such as hot offset may easily occur. Further, the temperature of the paper non-pass portion may become higher than an assumed temperature, thus causing a failure.

To address such an issue, a configuration is discussed in which in the above-described fixing unit, a plurality of thermistors disposed on the back of a heater is provided. More specifically, a center thermistor located at the center in a recording material width direction orthogonal to a recording material conveyance direction and an end thermistor located in an area corresponding to the paper non-pass portion for the small size recording material are disposed. In a case where the small size recording material is fed, the throughput of the recording material is decreased depending on the detected temperature of the end thermistor (Japanese Patent Application Laid-Open No. 2002-91226).

FIG. 10 illustrates the position of a center thermistor and an end thermistor in a paper width direction in a fixing nip portion, and a temperature distribution when a large size recording material and a small size recording material are fed. Temperature T0 is a limit temperature without a harmful effect due to an image defect such as the above-described hot offset or melt. Temperature T1 is a threshold value when the large size recording material is fed. Temperature T2 is a threshold value when the small size recording material is fed. When the temperature of the end thermistor while the paper is fed reaches the respective threshold values, the decrease of throughput is performed so as to prevent the temperature from increasing beyond the respective threshold values. As illustrated in FIG. 10, a peak (maximum temperature) in a paper width direction of the small size recording material is located closer to the center away from the end thermistor position than a peak of the large size recording material. Thus, the threshold temperature of the end thermistor when the small size recording material is selected is set lower than that when the large size recording material is selected. This threshold temperature is set depending on the selection of the recording material size by a user. In other words, when the user selects the recording material size via a personal computer or the like, a printer engine unit automatically sets the optimal threshold temperature according to size information selected by the user.

Accordingly, when the small size recording material is selected, the threshold temperature is set to the temperature for the small size recording material. When the detected temperature of the end thermistor reaches the threshold temperature for the small size recording material, the operation is shifted to the decrease of throughput of the recording material to reduce temperature rising at the end portion of the fixing unit. However, in the above-described conventional image forming apparatus, when a user erroneously sets the small size recording material to the large size recording material, a reduction in temperature rising at the end portion may become difficult. For example, a case is assumed in which the user selects A3 size paper, though the user should select A4 size paper, via a personal computer with A4 size paper set to a manual paper feed unit, which is unable to recognize the paper size.

The manual paper feed unit cannot recognize the paper size. However, since A4 size paper and A3 size paper are different in width and length, the length of the paper can be detected by a paper feed sensor that is normally provided on a printer. Thus, the printer engine unit can recognize that the actually conveyed paper is not A3 size paper selected by the user but is A4 size paper. In this case, paper conveyance may be discontinued to inform the image forming apparatus of a selection error.

However, in a case where in the size of the paper set on the manual paper feed unit, the width is equivalent to A4 size (or a further smaller size) and the length is equivalent to A3 size (in the case of nonstandard-size paper), when the user selects A3 size paper, even if the paper feed sensor detects the length of the paper, the length is equivalent to A3. Thus, the printer engine unit recognizes the actually conveyed paper is A3 size paper. In this case, the threshold temperature is set to the temperature for A3 size paper. Though the small size recording material is actually fed, the decrease of throughput is not performed until the detected temperature of the end thermistor reaches the threshold value for the large size recording material. Accordingly, the temperature peak value in the paper non-pass area for the small size paper is increased to exceed temperature T0 (FIG. 11). As the result of this, a harmful effect, such as an image defect such as the hot offset and a paper pass failure due to thermal deformation of a component, occurs.

On the other hand, if an exclusive sensor configured to detect the paper width is provided on the paper conveyance path, the above-described issue may be addressed. However, the exclusive sensor may cause a cost increase.

SUMMARY OF THE INVENTION

The present invention is directed to an image forming apparatus capable of reducing over temperature rising in a paper non-pass area at low cost even if a user erroneously sets a recording material size.

According to an aspect of the present invention, an image forming apparatus includes a transfer unit configured to transfer an image to a recording material, a fixing unit configured to fix, to the recording material, the image transferred to the recording material, a first curvature detection unit located between the transfer unit and the fixing unit and configured to adjust an amount of curvature of the recording material to a first amount of curvature, and a second curvature detection unit located between the transfer unit and the fixing unit and configured to adjust the amount of curvature of the recording material to a second amount of curvature, wherein the second curvature detection unit is located in a position different from the first curvature detection unit in a width direction orthogonal to a conveyance direction of the recording material.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 3:
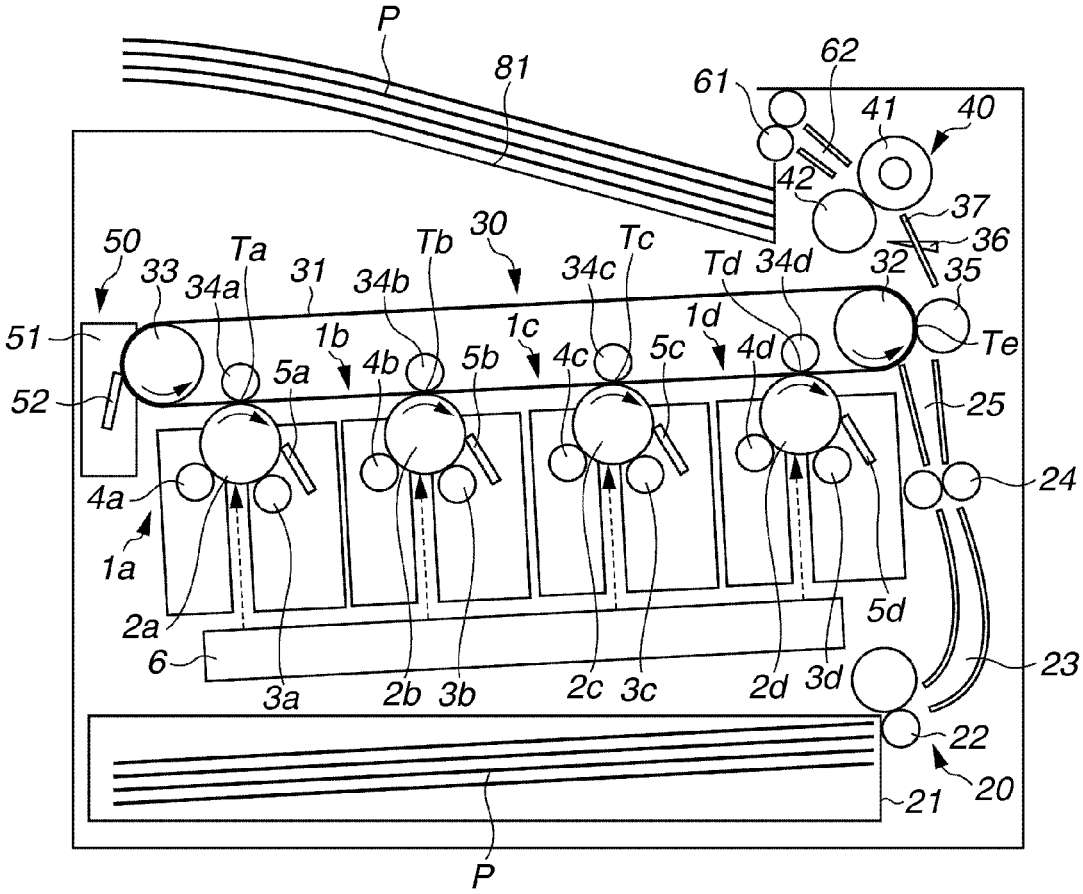
FIG. 3 is a schematic cross-sectional view illustrating an image forming apparatus according to the first to third exemplary embodiments of the present invention.

Referring to FIG. 3, the outline of an image forming apparatus cording to a first exemplary embodiment of the present invention will be described. The image forming apparatus in the present exemplary embodiment is a color image forming apparatus using an electrophotographic image forming process.

The image forming apparatus includes four image forming units, including an image forming unit 1*a* configured to form a yellow color image, an image forming unit 1*b* configured to form a magenta color image, an image forming unit 1*c* configured to form a cyan color image, and an image forming unit 1*d* configured to form a black color image. These four image forming units 1*a*, 1*b*, 1*c*, and 1*d* are disposed almost horizontally, in a line, and at a fixed interval.

In the respective image forming units 1*a*, 1*b*, 1*c*, and 1*d*, drum type electrophotographic photosensitive members (hereinafter, referred to as photosensitive drums) 2*a*, 2*b*, 2*c*, and 2*d* are installed as an image bearing member, respectively. Around the respective photosensitive drums 2*a*, 2*b*, 2*c*, and 2*d*, charging devices 3*a*, 3*b*, 3*c*, and 3*d*, development devices 4*a*, 4*b*, 4*c*, and 4*d*, and drum cleaning devices 5*a*, 5*b*, 5*c*, and 5*d* are installed, respectively. Below the mage forming units 1*a*, 1*b*, 1*c*, and 1*d*, an exposure device 6 is installed. In the respective development devices 4*a*, 4*b*, 4*c*, and 4*d*, a yellow toner, a magenta toner, a cyan toner, and a black toner are stored.

The respective photosensitive drums 2*a*, 2*b*, 2*c*, and 2*d* are negatively charged OPC photosensitive members, have a photoconductive layer on an aluminum-made drum substrate, and are driven in rotation at a predetermined process speed in an arrow direction (clockwise) by a drive device (not illustrated). The charging devices 3*a*, 3*b*, 3*c*, and 3*d* as a charging unit uniformly charge the surfaces of the respective photosensitive drums 2*a*, 2*b*, 2*c*, and 2*d* at a negatively polarized predetermined electrical potential by a charged bias applied from a charging bias power source (not illustrated).

The development devices 4*a*, 4*b*, 4*c*, and 4*d* cause toners of respective colors to adhere to each electrostatic latent image formed on the respective photosensitive drums 2*a*, 2*b*, 2*c*, and 2*d* to develop the electrostatic latent image as a toner image (visibly image). As a development method by the development devices 4*a*, 4*b*, 4*c*, and 4*d*, for example, a two component contact development method can be used which uses a mixture of a magnetic carrier to a toner particle as a developer, conveys the developer by magnetic force, and develops the images in a contact state to the respective photosensitive drums 2*a*, 2*b*, 2*c*, and 2*d*.

Primary transfer rollers 34*a*, 34*b*, 34*c*, and 34*d* as a transfer unit are formed out of an elastic member and abut on the respective photosensitive drums 2*a*, 2*b*, 2*c*, and 2*d* in each transfer nip portion via an endless belt-like intermediate transfer belt 31. As a transfer unit, the transfer rollers 34*a*, 34*b*, 34*c*, and 34*d* are used. However, a transfer blade that abuts on the intermediate transfer belt 31 may be employed.

The drum cleaning devices 5*a*, 5*b*, 5*c*, and 5*d* remove and recover a transfer remaining toner that remains on the respective surfaces of the photosensitive drums 2*a*, 2*b*, 2*c*, and 2*d*. In the exposure device 6, laser light modulated corresponding to a time-series electric digital pixel signal of image information is output from a laser output unit (not illustrated) to expose the surfaces of the respective photosensitive drums 2*a*, 2*b*, 2*c*, and 2*d* via a polygon mirror (not illustrated) that rotates at a high speed. Thus, an electrostatic latent image of each color corresponding to the image information is formed on the surfaces of the respective photosensitive drums 2*a*, 2*b*, 2*c*, and 2*d* charged by the respective charging devices 3*a*, 3*b*, 3*c*, and 3*d*.

A paper feed unit 20 includes a paper feed cassette 21, a pickup roller pair 22, a conveyance guide 23, a registration roller pair 24, and a pre-transfer conveyance guide 25. The paper feed unit 20 feeds and conveys a recording material P in the paper feed cassette 21 to a secondary transfer portion Te.

In an intermediate transfer unit 30, an intermediate transfer belt 31 is tensioned and laid between a drive roller 32 and a tension roller 33, and is rotated (moved) in an arrow direction (counterclockwise) by the drive roller 32. The intermediate transfer belt 31 is formed out of a dielectric resin such as a polycarbonate resin film, a polyethylene terephthalate resin film, or a polyvinylidene fluoride resin film.

Figure 9:
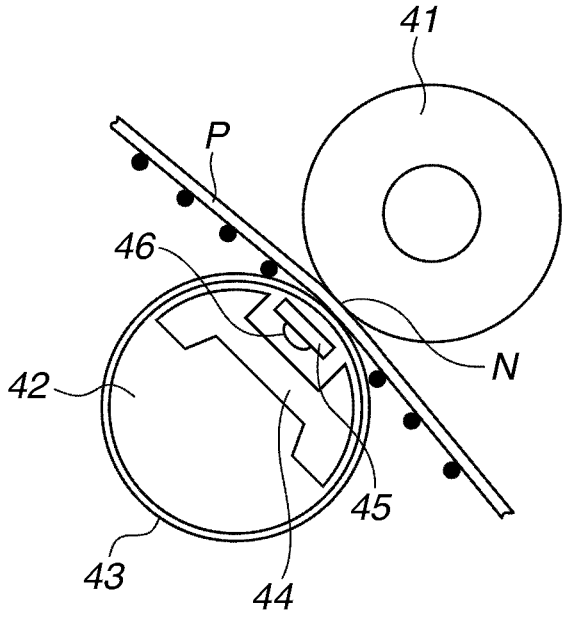
FIG. 9 is a schematic cross-sectional view illustrating a fixing unit.
Figure 13:
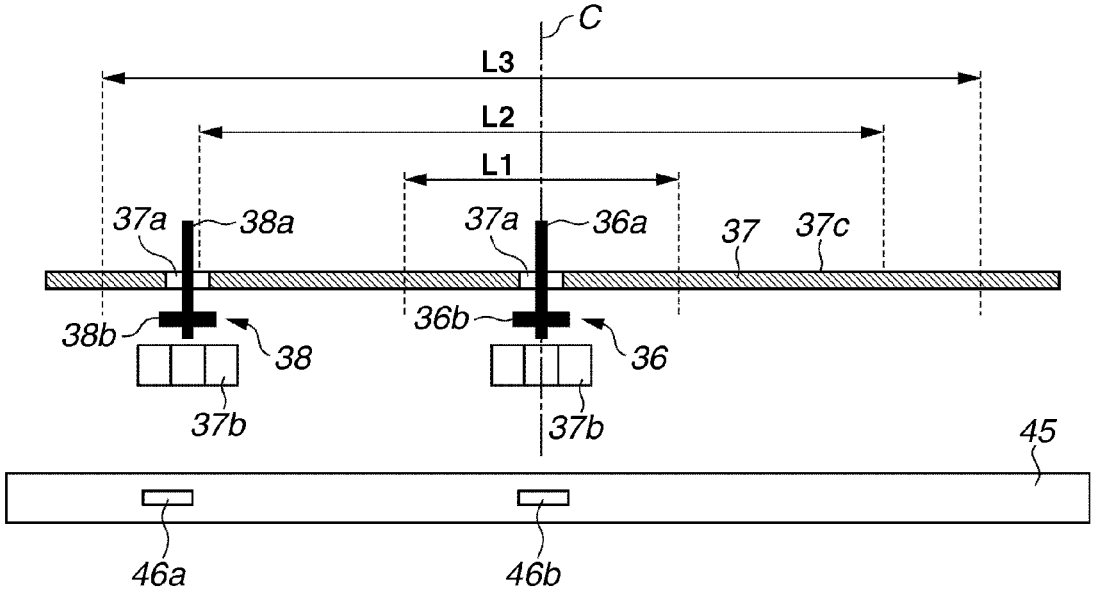
FIG. 13 is a diagram illustrating a positional relationship between the loop detection unit and a heater according to the first exemplary embodiment.

Further, on the downstream side in a paper pass direction of the secondary transfer portion Te, a fixing unit (fixing portion) 40 including a fixing film 43, which contains a heater 45, and a pressure roller 41 is installed. Between the secondary transfer portion Te and the fixing unit 40, a conveyance guide 37 and a loop detection unit (hereinafter, also referred to as a curvature detection unit) 36 are disposed. Furthermore, on the downstream side in a paper pass direction of the fixing unit 40, a paper discharge roller pair 61 and a conveyance guide 62, which guides the recording material P to be conveyed from the fixing unit 40, are installed. The cross-sectional configuration of the fixing unit 40 is similar to that in FIG. 9. Thus, the description is omitted. FIG. 13 illustrates a positional relationship between loop detection units 36 and 38, which will be described below, and the heater 45. During fixing processing, the heater 45 is controlled such that the detected temperature of a temperature detection sensor 46*b* provided at the center remains at a predetermined fixing temperature.

Next, an image forming operation by the above-described image forming apparatus will be described. When an image forming start signal is generated, the respective photosensitive drums 2*a*, 2*b*, 2*c*, and 2*d* on the respective image forming units 1*a*, 1*b*, 1*c*, and 1*d* to be driven in rotation at a predetermined process speed are uniformly charged with negative polarity by the charging devices 3*a*, 3*b*, 3*c*, and 3*d*, respectively. Then, the exposure device 6 converts the image signal of an output image into an optical signal in a laser output unit (not illustrated). The laser light as the converted optical signal scans and exposes the charged respective photosensitive drums 2*a*, 2*b*, 2*c*, and 2*d* to form an electrostatic latent image.

Then, first, a yellow toner adheres to the electrostatic latent image formed on the photosensitive drum 2*a* via the development device 4*a* applied with a development bias the polarity of which is similar to the charged polarity (negative polarity) of the photosensitive drum 2*a* to convert the electrostatic latent image into a visible toner image. Then, the yellow toner image is transferred to the intermediate transfer belt 31 by the primary transfer roller 34*a* applied with the transfer bias (reverse polarity (positive polarity) to the charged polarity of the toner) in a primary transfer portion Ta.

The intermediate transfer belt 31, to which the yellow toner image is transferred, is moved to the image forming unit 1*b* by the intermediate transfer member belt drive roller 32. Then, also in a primary transfer portion Tb constituted of the image forming unit 1*b* and the primary transfer roller 34*b*, similarly to the above, a magenta toner image formed on the photosensitive drum 2*b* is superposed on the yellow toner image on the intermediate transfer belt 31 and transferred thereto. In the following, similarly, cyan and black toner images formed on the photosensitive drums 2*c* and 2*d* on the image forming units 1*c* and 1*d* are subsequently superposed on the yellow and magenta toner images transferred in superimposition on the intermediate transfer belt 31 by the respective primary transfer portions Tc and Td to form a full color toner image on the intermediate transfer belt 31.

Then, the recording material P to be fed from the paper feed cassette 21 by the pickup roller pair 22 reaches the registration roller pair 24 via the conveyance guide 23 according to the timing when the tip end of the toner image on the intermediate transfer belt 31 is moved to the secondary transfer portion Te, and is then conveyed to the transfer unit Te according to the timing of the full color toner image formed on the intermediate transfer belt 31. Then, the full color toner image is transferred to the recording material P by a secondary transfer roller 35 applied with the transfer bias (reverse polarity (positive polarity) to the charged polarity of the toner) on the recording material P conveyed to the secondary transfer portion Te.

Figure 12:
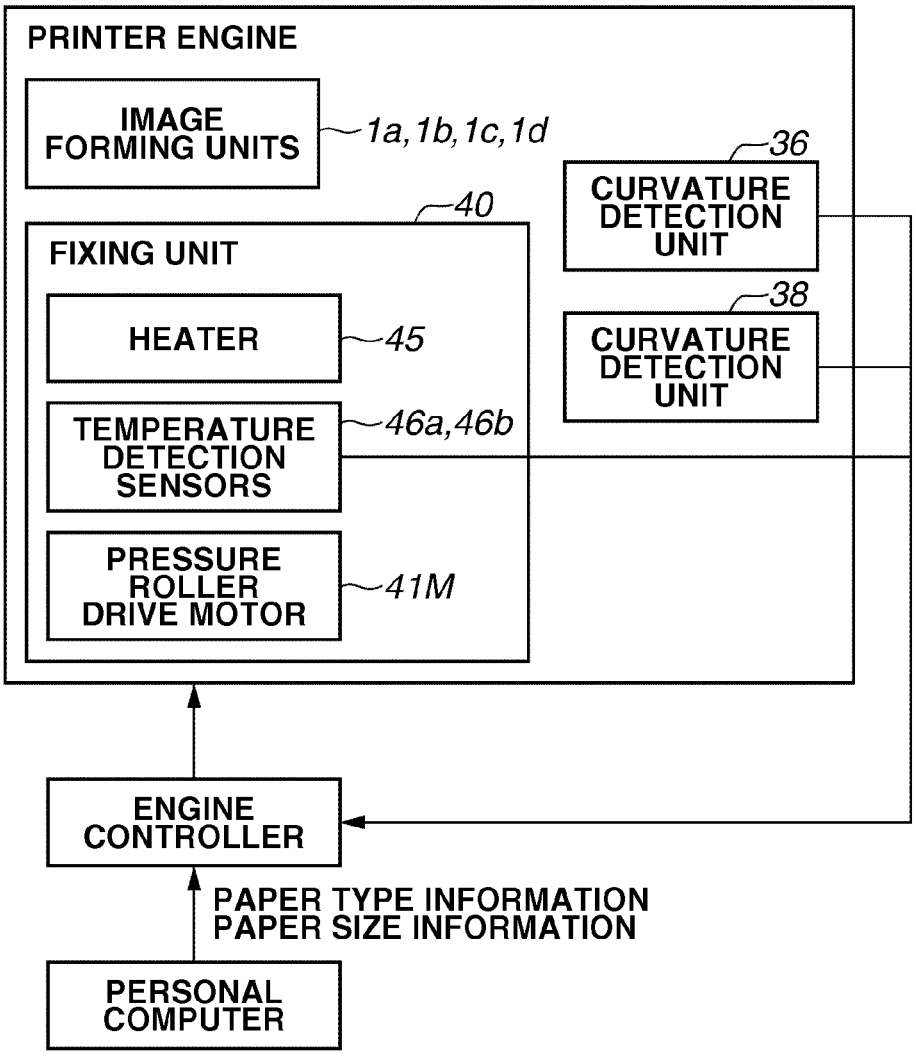
FIG. 12 is a block diagram illustrating a relationship between a printer engine and an engine controller.

The recording material P on which the full color toner image is formed is conveyed to the fixing unit 40 as an image heating device. The full color toner image is heated and pressed at the fixing nip to thermally fix the full color toner image to the surface of the recording material P. At this time, while the recording material P is interposed and conveyed between the secondary transfer portion Te and the fixing unit 40, a rotation speed of the fixing unit 40 is changed based on information about the amount of loop (amount of curvature) of the loop detection unit (curvature detection unit) 36 (38) to control the conveyance speed of the recording material P such that an image defect does not occur with the recording material P stretched and slacked (hereinafter, referred to as loop control). The recording material P passing through the fixing unit 40 is moved through the conveyance guide 62, and then discharged to a paper discharge tray 81 outside the apparatus by the paper discharge roller pair 61. Then, a series of image forming operations ends. As illustrated in FIG. 12, when a user selects the type and size of the recording material via a personal computer, the selected information is transmitted to the engine controller to set a fixing temperature, threshold temperature, and the like.

Figure 1:
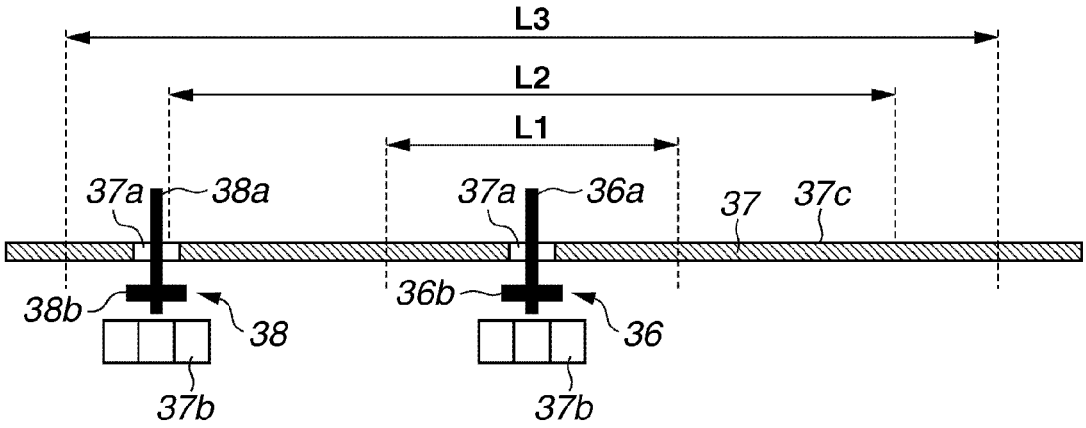
FIG. 1 is a schematic diagram illustrating a loop detection unit according to a first exemplary embodiment of the present invention.
Figure 4A:
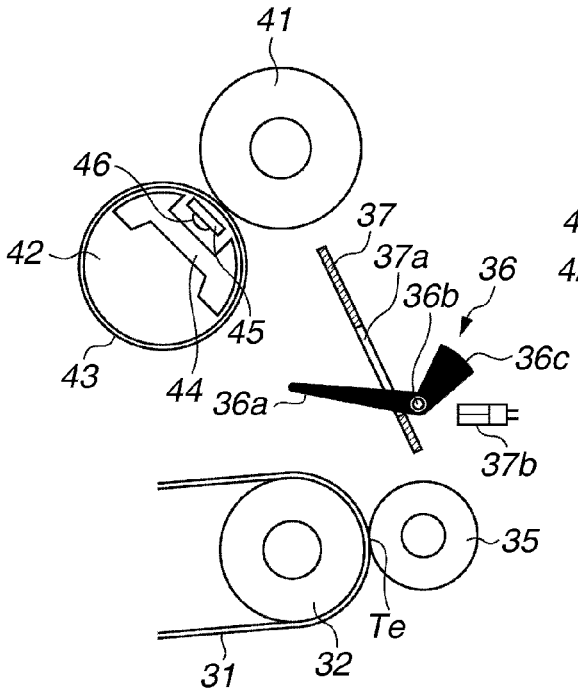
FIGS. 4A and 4B are schematic diagrams illustrating a loop detection unit for plain paper according to the first to third exemplary embodiments of the present invention.
Figure 4B:
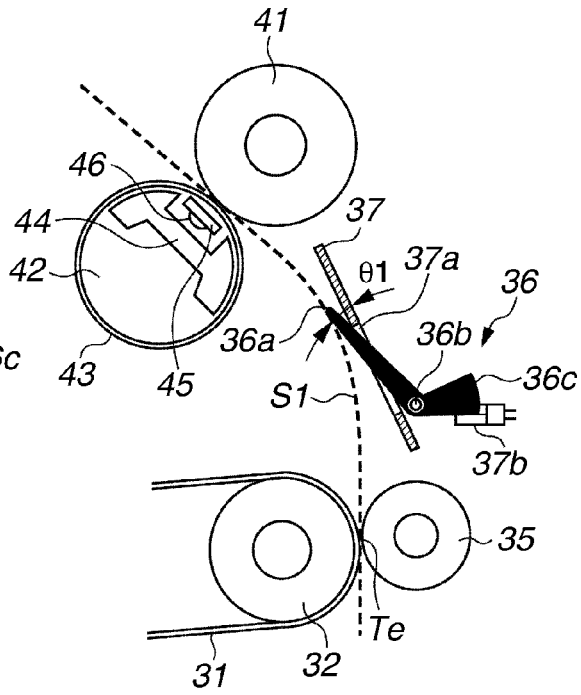
Figure 5A:
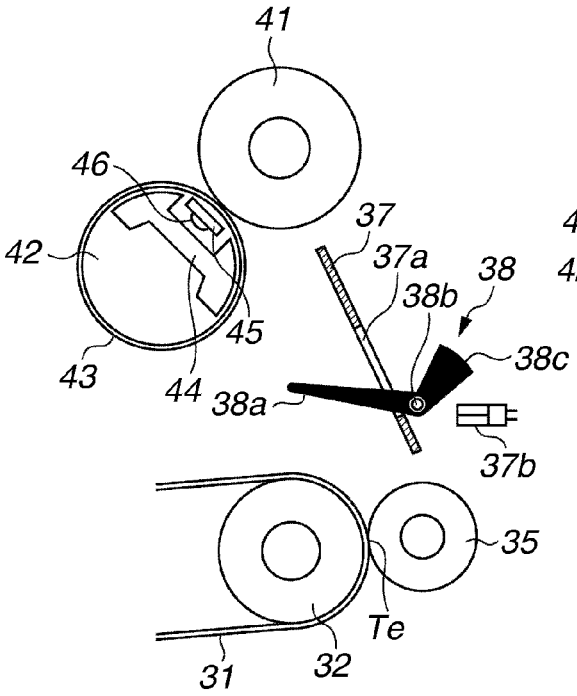
FIGS. 5A and 5B are schematic diagrams illustrating a loop detection unit for heavy paper according to the first to third exemplary embodiments of the present invention.
Figure 5B:
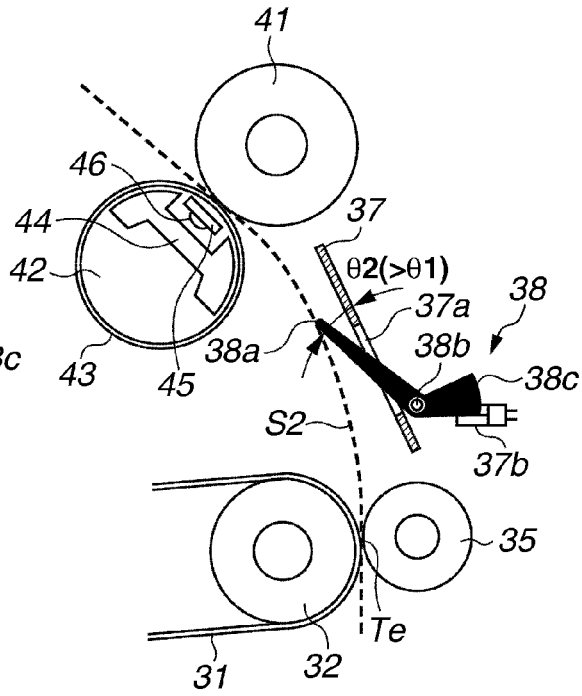

Next, referring to FIGS. 4A and 4B and FIGS. 5A and 5B, the detail configuration and operation of the loop detection unit will be described. FIGS. 4A and 4B and FIGS. 5A and 5B illustrate enlarged schematic diagrams around the loop detection unit 36 in FIG. 3. FIGS. 4A and 4B illustrate a movement of the loop detection unit when a recording material weak in stiffness (e.g., plain paper with a grammage of 50 to 120 g/m$^2$) is conveyed. FIGS. 5A and 5B illustrate a movement of the loop detection unit when a recording material strong in stiffness (e.g., heavy paper with a grammage of 120 g/m$^2$ or more) is conveyed. As illustrated in FIG. 1, two loop detection units are provided. The loop detection unit 36 (first curvature detection unit) is disposed inside a pass area of the recording material with the predetermined minimum size L1 usable on a printer in a width direction orthogonal to the conveyance direction of the recording material. The loop detection unit 38 (second curvature detection unit) is disposed outside the pass area of the recording material with the minimum size L1. The loop detection unit 36 is used when plain paper is used as the recording material and is used to adjust the amount of curvature of the recording material to a first amount of curvature. The loop detection unit 38 is used when heavy paper the width of which is larger than the minimum size L1 is used as the recording material and is used to adjust the amount of curvature of the recording material to a second amount of curvature, which is smaller than the first amount of curvature.

First, in FIG. 4A, the loop detection unit 36 (hereinafter, referred to as a loop detection unit for plain paper 36) includes a tip end 36*a* projected from a hole 37*a* opened on the conveyance guide 37 to contact the recording material P, a rotation center axis 36*b* of the loop detection unit for plain paper 36, and a flag portion 36*c*. On the rotation locus of the flag portion 36*c*, a photo interrupter 37*b* is disposed. Next, as illustrated in FIG. 4B, when the loop (curvature) of the recording material P is formed to a locus S1, the loop detection unit 36 is pushed by the loop, and the flag portion 36*c* is rotated to a position to shield the photo interrupter 37*b* (an angle to the guide 37 at the tip end 36*a* at this time is θ1). When the flag portion 36*c* shields the photo interrupter 37*b* (hereinafter, referred to as ON), the signal is transmitted to the controller to increase the rotation speed of the fixing unit 40 (pressure roller drive motor 41M) so as to reduce the loop of the recording material P (reduce curvature). As a result of this, the amount of loop of the recording material P is reduced. When the loop detection unit for plain paper 36 is rotated and the photo interrupter 37*b* transmits light again (hereinafter, referred to as OFF), the signal is transmitted to the controller again and, in order to increase the loop of the recording material P (increase curvature), the rotation speed of the fixing unit 40 is reduced.

As described above, ON/OFF of the photo interrupter 37*b* is repeated by the rotation of the loop detection unit for plain paper 36. The signal is received to change the speed of the fixing unit 40, thereby executing loop control. Thus, the amount of curvature of plain paper is adjusted so as to retain the first amount of curvature.

The loop detection unit 38 (hereinafter, referred to as a loop detection unit for heavy paper 38) in FIGS. 5A and 5B is disposed in the same position as the loop detection unit for plain paper 36 in a paper pass direction to the conveyance guide 37 and disposed in a different position in a paper width direction. Similarly to the loop detection unit for plain paper 36, the loop detection unit for heavy paper 38 also includes a tip end 38*a* projected from the hole 37*a* opened on the conveyance guide 37 to contact the recording material P, a rotation center axis 38*b* of the loop detection unit for heavy paper 38, and a flag portion 38*c*. On the rotation locus of the flag portion 38*c*, the photo interrupter 37*b* is disposed.

On the other hand, the relative position between the flag portion 38*c* and the tip end 38*a* is different from that in the loop detection unit for plain paper 36. In the loop detection unit for heavy paper 38, timing to turn ON the photo interrupter 37*b* by rotation is set earlier. Accordingly, as illustrated in FIG. 5B, loop control is started at the place where the loop of the recording material P is formed to a locus S2 the curvature of which is smaller than the locus S1 (an angle to the guide 37 at the tip end 38*a* at this time is θ2 (>θ1)). The amount of loop is smaller than the amount of loop at the time of loop control by the loop detection unit for plain paper 36. Thus, the amount of curvature of heavy paper is adjusted to retain the second amount of curvature, which is smaller than the first amount of curvature.

As described above, by setting the type of paper, discriminated with the grammage of paper, by a user or by a unit configured to automatically determine the grammage of paper to be fed, the image forming apparatus recognizes the grammage of paper to be fed and selects one of the loop detection unit for plain paper 36 and the loop detection unit for heavy paper 38 to execute the optimal loop control using a signal from the selected loop detection unit.

Figure 2:
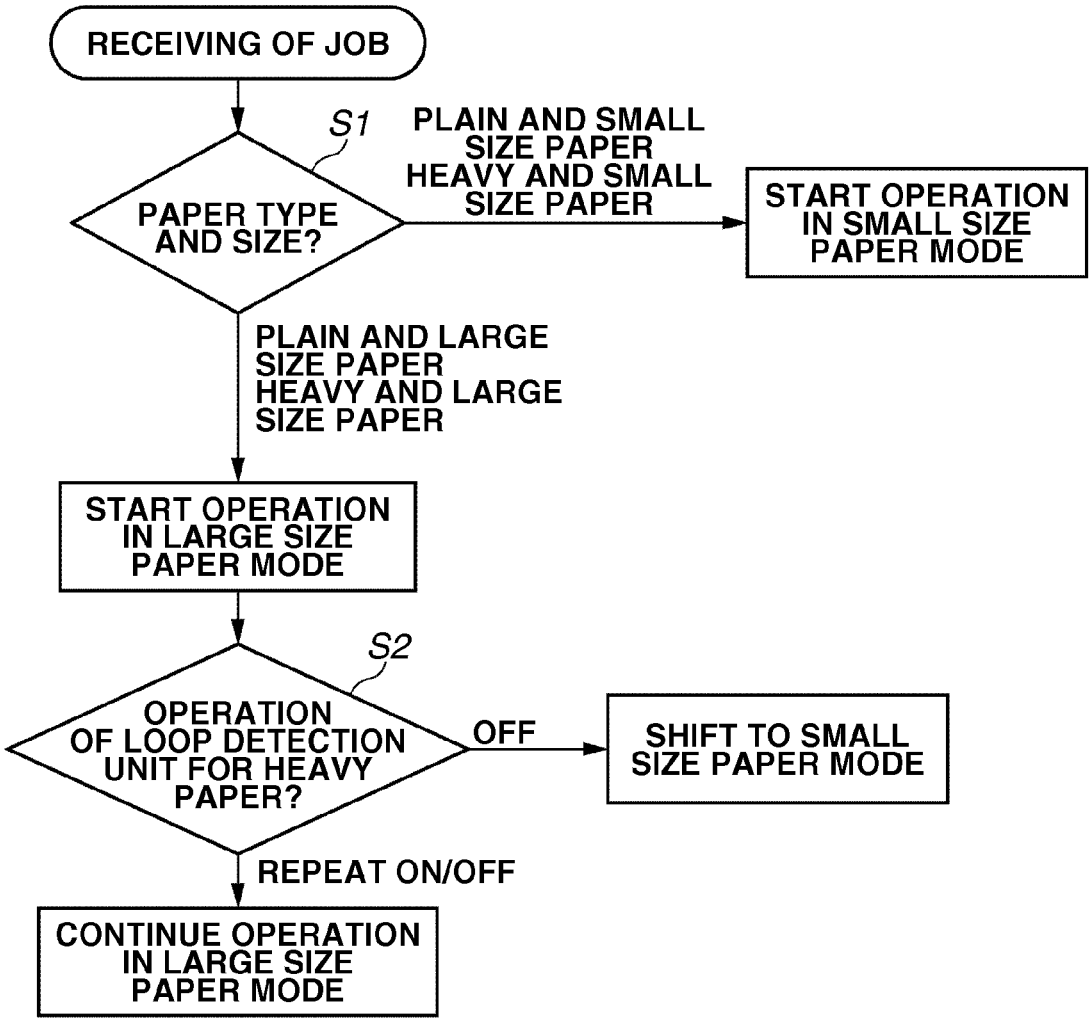
FIG. 2 is a flowchart illustrating an operation of an image forming apparatus according to the first exemplary embodiment of the present invention.

A peculiar portion in the present exemplary embodiment will be described below referring to FIGS. 1 and 2. First, FIG. 1 illustrates a schematic cross-sectional view of the conveyance guide 37 in FIG. 3 as viewed from the upstream side in a recording material conveyance direction.

In FIG. 1, the loop detection unit for plain paper 36 is disposed inside the paper passable minimum paper width size L1 to the conveyance guide 37, and the loop detection unit for heavy paper 38 is disposed outside the minimum paper width size L1 and inside the paper passable maximum paper width size L3. In the loop detection unit for plain paper 36 and the loop detection unit for heavy paper 38, the tip end 36*a* and the tip end 38*a* are projected from the hole 37*a* on the conveyance guide 37 to a paper pass surface side 37*c*.

The minimum paper width size L1 is set to, for example, 148 mm of A5 size, the maximum paper width size L3 is set to, for example, 320 mm of SRA3 size, and the maximum paper width size L2 without overlapping the loop detection unit for heavy paper 38 is set to 200 mm slightly smaller than A4 size.

The printer engine executes loop control and paper size detection as described below when conveying a recording material. First, when a signal to feed small size plain paper is received from the engine controller, the loop control is executed using a signal from the loop detection unit for plain paper 36. On the other hand, it is confirmed that the loop detection unit for heavy paper 38 remains turned off. Further, also when a signal to feed large size plain paper is received, the loop control is executed using a signal from the loop detection unit for plain paper 36. On the other hand, it is confirmed that the loop detection unit for heavy paper 38 repeats turned-on/off.

Next, when a signal to feed small size heavy paper is received, the loop control is executed using a signal from the loop detection unit for plain paper 36. It is confirmed that the loop detection unit for heavy paper 38 remains turned off. Further, when a signal to feed large size heavy paper is received, the loop control is executed using a signal from the loop detection unit for heavy paper 38. On the other hand, it is confirmed that the loop detection unit for plain paper 36 also repeats turned-on/off.

Figure 10:
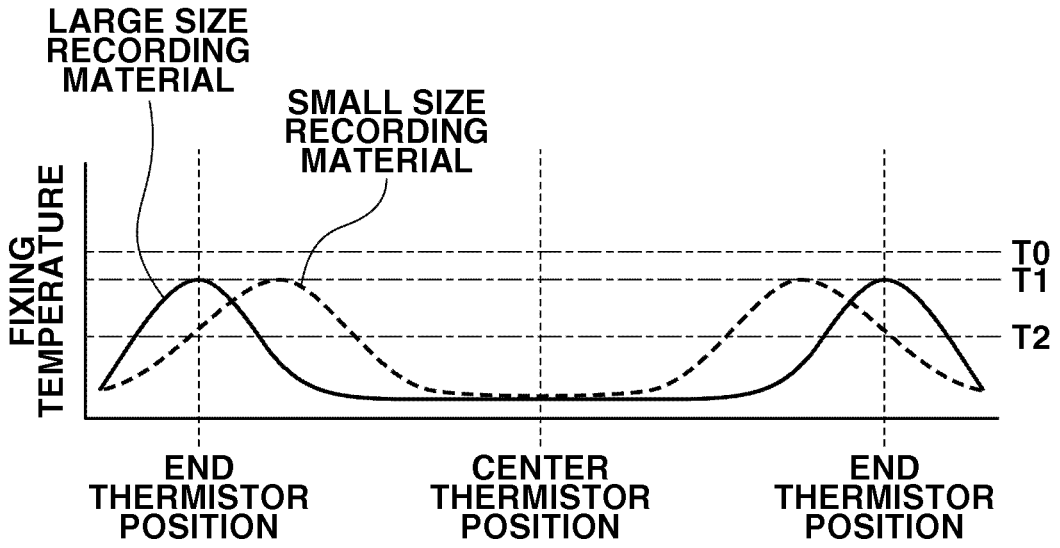
FIG. 10 is a temperature distribution diagram illustrating a state where the setting of a threshold temperature is correct and the temperature in a recording material non-pass area on a fixing unit is reduced at T0 or lower.
Figure 11:
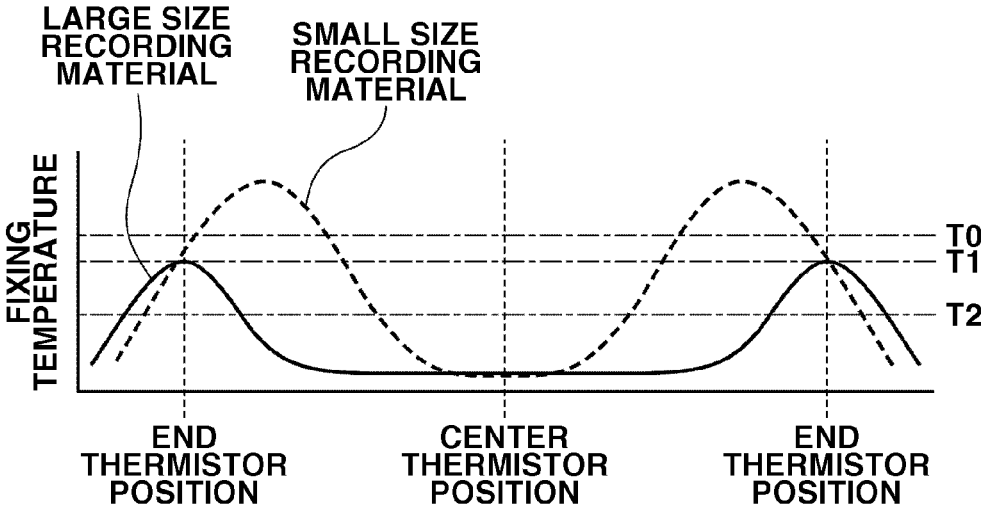
FIG. 11 is a temperature distribution diagram illustrating a state where the setting of a threshold temperature is erroneous and the temperature in a recording material non-pass area on a fixing unit exceeds T0.

When small size paper is fed, as illustrated in FIGS. 10 and 13, the threshold temperature of the end thermistor 46*a* is set to T2. When the temperature of the end thermistor 46*a* while paper is fed reaches the threshold temperature T2, the decrease of throughput is performed (the conveyance interval of a plurality of recording materials to be continuously conveyed is expanded). This operation mode is referred to as a small size paper mode. On the other hand, when large size paper is fed, as similarly illustrated in FIGS. 10 and 13, the threshold temperature of the end thermistor 46*a* is set to T1.

When the temperature of the end thermistor 46*a* while paper is fed reaches the threshold temperature T1, the decrease of throughput is performed. This operation mode is referred to as a large size paper mode.

Next, referring to FIG. 2, an actual output operation will be described. FIG. 2 is a flowchart illustrating an operation of the image forming apparatus according to the present exemplary embodiment. First, when the image forming apparatus receives a job signal, in step S1, the image forming apparatus selects whether to start an operation in the large size paper mode or the small size paper mode according to a recording material type and a recording material size present in job contents. At this time, if the set recording material size is small size, from the beginning, the operation is started in the small size paper mode. On the other hand, if the set recording material size is large size, once the operation is started in the large size paper mode. When the operation is started in the large size paper mode, in step S2, the image forming apparatus determines whether the actually fed recording material matches the preset paper size according to whether the loop detection unit for heavy paper 38 repeats turned-on/off or remains turned off. As the result of determination in step S2, if the loop detection unit for heavy paper 38 is not turned on, regardless of the job signal, it is determined that the fed recording material is of small size. Then, the operation is shifted to the small size paper mode from the next recording material.

As described above, even if the recording material size different from the set recording material size is used, the loop detection units separately disposed in a paper width direction are used as the recording material size detection unit, so that paper can be fed in the correct recording material size mode. Further, paper size detection is executed between the secondary transfer portion and the fixing unit where loop control is executed such that paper behavior is stable. Thus, the paper size can accurately be detected.

Furthermore, the loop detection unit for plain paper 36 large in the amount of loop is disposed inside the paper passable minimum paper width size, so that the loop control of plain paper high in use frequency can securely be executed. In this case, since small size heavy paper does not overlap the loop detection unit for heavy paper 38, the loop control is executed by the loop detection unit for plain paper 36. However, since in the heavy paper narrow in paper width, also stiffness of paper is not so strong, even the loop control by the loop detection unit for plain paper 36 can sufficiently cope therewith.

As described above, even if the setting of the recording material size by the user is erroneous, paper is fed in the correct recording material size mode. Thus, temperature rising at the end portion can be reduced. Accordingly, an image defect such as hot offset and a failure where surrounding components are melted by abnormal high temperature can also be prevented. Therefore, a high-quality image forming apparatus can be realized.

Figure 6:
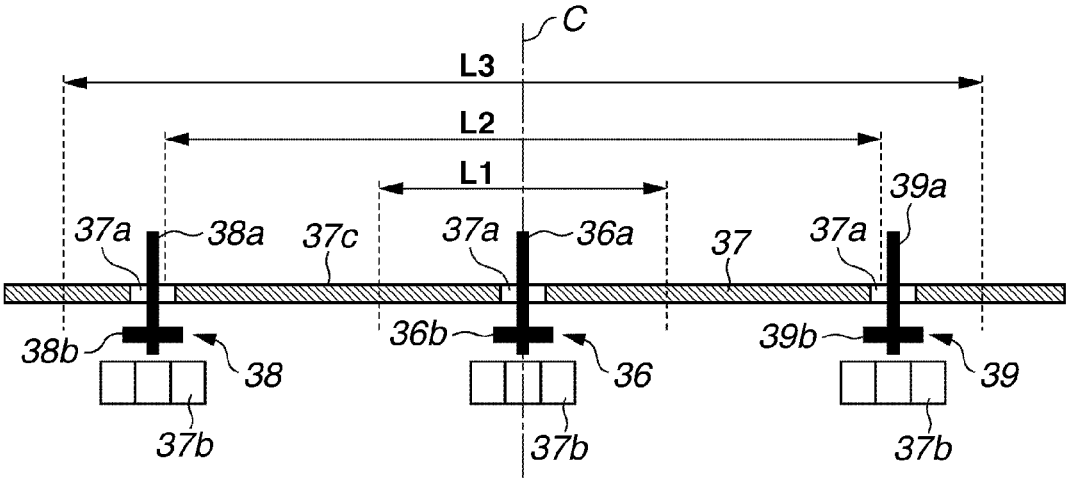
FIG. 6 is a schematic diagram illustrating a loop detection unit according to the second exemplary embodiment of the present invention.

Similarly to FIG. 1, FIG. 6 illustrates a schematic cross-sectional view of the conveyance guide 37 in FIG. 3 as viewed from the upstream side in a recording material conveyance direction, according to a second exemplary embodiment of the present invention. In FIG. 6, a detection unit 39 with a configuration similar to the loop detection unit for heavy paper 38 is disposed in a position symmetrical with the position of the loop detection unit for heavy paper 38 with respect to a center line C in a paper width direction. Similarly to the loop detection units 37 and 38, the detection unit 39 includes a tip end 39*a* projected from a hole 37*a* opened on the conveyance guide 37 to contact the recording material P, a rotation center axis 39*b*, and a flag portion 39*c* (not illustrated). On the rotation locus of the flag portion 39*c* (not illustrated), the photo interrupter 37*b* is disposed. The relative position between the flag portion 39*c* (not illustrated) and the tip end 39*a* is also similar to that in the loop detection unit for heavy paper 38. However, the detection unit 39 is not used for the loop control but is used to only execute detection of the presence or absence of a recording material by turned-on/off of the photo interrupter 37*b*.

According to the second exemplary embodiment, in addition to the effect similar to the first exemplary embodiment, the second exemplary embodiment can cope with a case in which the recording material P of the paper passable minimum paper width size is biased to one side to be fed. In the case of the first exemplary embodiment, for example, when the recording material P of the paper passable minimum paper width size is biased to the loop detection unit for heavy paper 38 side to be fed, both the loop detection unit for heavy paper 38 and the loop detection unit for plain paper 36 are turned on. In this case, although, on the opposite side to the loop detection unit for heavy paper 38, temperature rises at the end portion, the recording material P may be erroneously recognized to of large size.

Then, in the present exemplary embodiment, even if the recording material P of the paper passable minimum paper width size is biased to the loop detection unit for heavy paper 38 side to be fed, since the detection unit 39 is not turned on, it can be determined that the small size recording material is biased. Thus, the operation can be shifted to the small size mode.

Accordingly, similarly to the first exemplary embodiment, even if the setting of the recording material size by the user is erroneous, paper is fed in the correct recording material size mode, so that temperature rising at the end portion can be reduced. Thus, an image defect such as hot offset and a failure where surrounding components are melted by abnormal high temperature can also be prevented. Therefore, a high-quality image forming apparatus can be realized.

Figure 7:
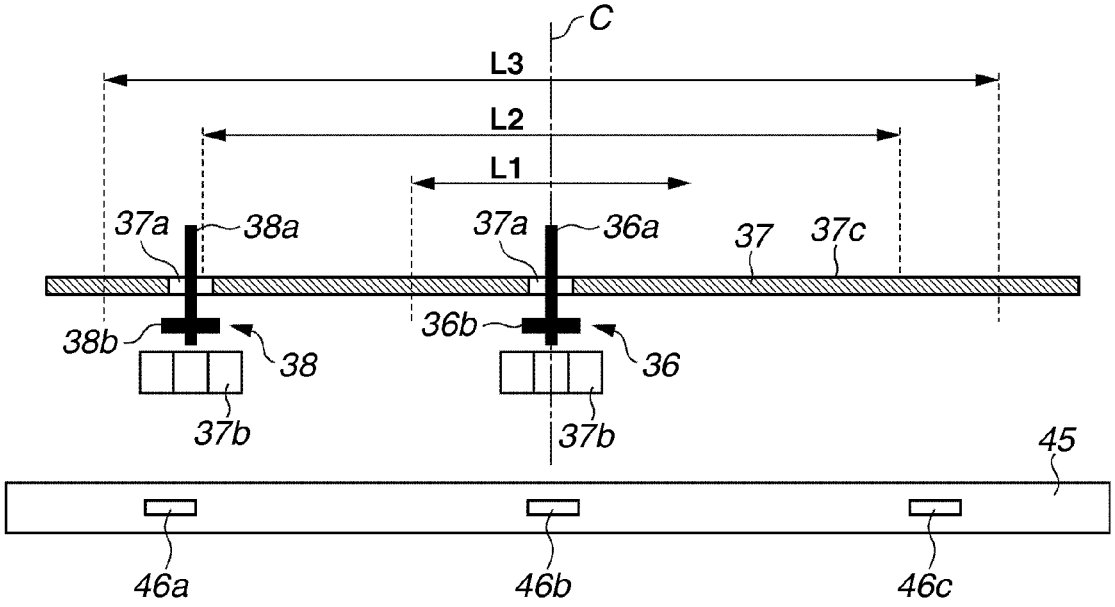
FIG. 7 is a schematic diagram illustrating a loop detection unit according to the third exemplary embodiment of the present invention.
Figure 8:
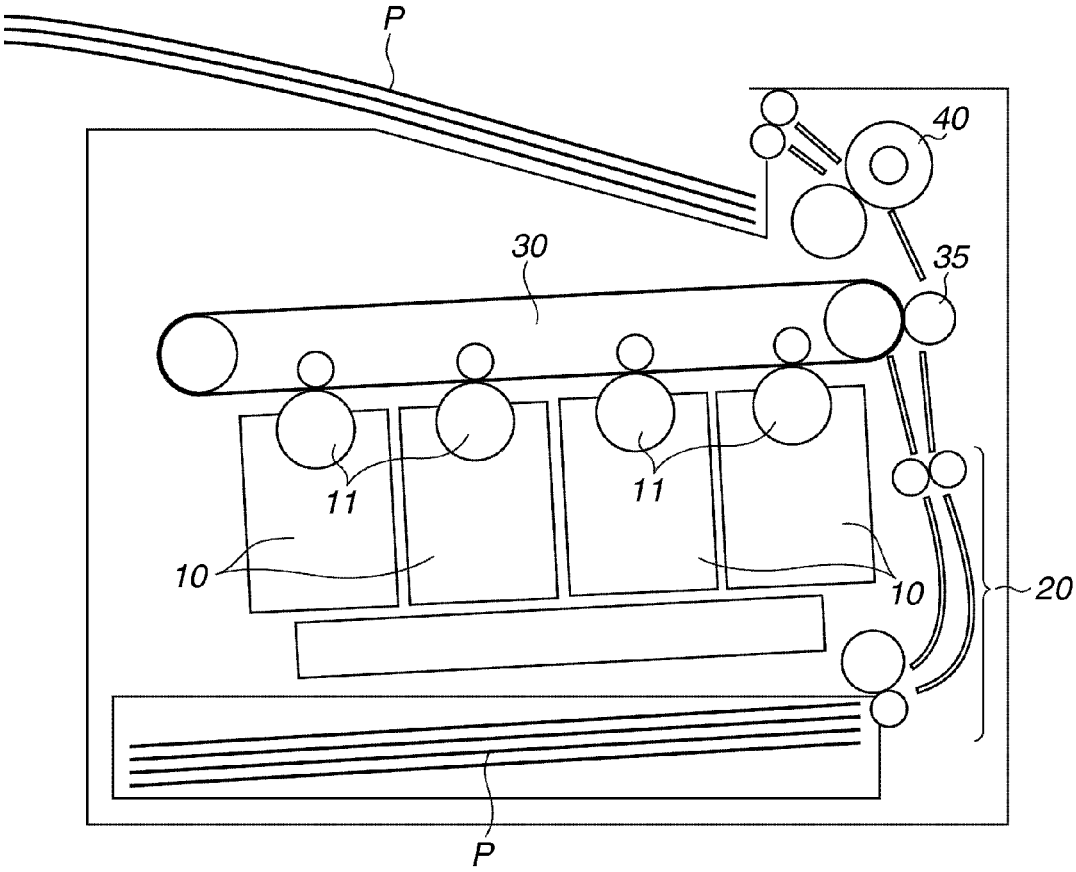
FIG. 8 is a schematic cross-sectional view illustrating an image forming apparatus.

Similarly to FIG. 1, FIG. 7 is a schematic cross-sectional view of the conveyance guide 37 in FIG. 3 as viewed from the upstream side in a recording material conveyance direction, according to a third exemplary embodiment of the present invention, which also illustrates a positional relationship in a paper width direction between a heater and a thermistor in the fixing unit 40. Referring to FIG. 7, with the heater 45 in the fixing unit 40, a thermistor 46*b* is in contact at the center, and thermistors 46*a* and 46*c* are in contact at the ends. The position in the paper width direction of the end thermistor 46*a* is near the position in a paper width direction of the loop detection unit for heavy paper 38. The end thermistor 46*c* is disposed in a position symmetric with the position of the end thermistor 46*a* with respect to a center line (a standard of recording material conveyance) C in the paper width direction.

In a peculiar portion in the present exemplary embodiment, temperature information on both end thermistors is continuously transmitted to the controller while paper is fed. When a thermistor temperature difference between both ends becomes greater than a predetermined value, it is determined that biased paper pass is performed, so that the operation is shifted to the small size mode.

According to the third exemplary embodiment, in addition to the effect similar to the first exemplary embodiment, the third exemplary embodiment can cope with a case in which the recording material P of the paper passable minimum paper width size is biased to be fed. Further, the third exemplary embodiment can be realized without increasing a detection unit and a photo interrupter as in the second exemplary embodiment. Thus, an increase in cost can be reduced.

Thus, even if the setting of a recording material size by a user is erroneous, or even if a recording material is biased to one side to be fed, paper is fed in the correct recording material size mode, so that temperature rising at the end portion can be reduced. Accordingly, an image defect such as hot offset and a failure where surrounding components are melted by abnormal high temperature can also be prevented. Therefore, a high-quality image forming apparatus can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-201083 filed Sep. 8, 2010 and No. 2011-143024 filed Jun. 28, 2011, which are hereby incorporated by reference herein in their entirety.

What is claimed is:

1. An image forming apparatus comprising:

a transfer unit configured to transfer an image to a recording material;

a fixing unit configured to fix, to the recording material, the image transferred to the recording material;

a first curvature detection unit located between the transfer unit and the fixing unit and configured to adjust an amount of curvature of the recording material to a first amount of curvature; and a second curvature detection unit located between the transfer unit and the fixing unit and configured to adjust the amount of curvature of the recording material to a second amount of curvature, wherein the second curvature detection unit is located in a position different from the first curvature detection unit in a width direction orthogonal to a conveyance direction of the recording material.

2. The image forming apparatus according to claim 1, wherein the first curvature detection unit is located inside a pass area for a recording material of a predetermined minimum size usable by the image forming apparatus, and the second curvature detection unit is located outside the pass area.

3. The image forming apparatus according to claim 2, wherein, when an image is formed on plain paper, the image forming apparatus adjusts the amount of curvature to the first amount of curvature using the first curvature detection unit, and wherein, when an image is formed on heavy paper having a width passable through a position at which the second curvature detection unit is located, the image forming apparatus adjusts the amount of curvature to the second amount of curvature using the second curvature detection unit.

4. The image forming apparatus according to claim 2, wherein the first curvature detection unit and the second curvature detection unit are located in a same position in the conveyance direction of the recording material.

5. The image forming apparatus according to claim 3, wherein the second amount of curvature is smaller than the first amount of curvature.

6. The image forming apparatus according to claim 3, wherein, when an image is formed on heavy paper having a width impassable through a position at which the second curvature is located, the image forming apparatus adjusts the amount of curvature to the first amount of curvature using the first curvature detection unit.

7. The image forming apparatus according to claim 2, wherein the fixing unit includes a first temperature detecting element configured to detect a temperature in an area through which the recording material of the predetermined minimum size passes and a second temperature detecting element configured to detect a temperature outside the area, and wherein when a detected temperature of second temperature detecting element while the recording material is fed reaches a threshold temperature, a conveyance interval of a plurality of recording materials to be continuously conveyed is expanded.

8. The image forming apparatus according to claim 7, wherein in a case where the recording material has a size passable through both a position at which the first curvature detection unit is located and a position at which the second curvature detection unit is located, the threshold temperature is set at a first threshold temperature, and wherein in a case where the recording material has a size impassable through the position where the second curvature detection unit is located, the threshold temperature is set at a second threshold temperature lower than the first threshold temperature.

9. The image forming apparatus according to claim 1, further comprising a recording material detection unit for detecting a presence or absence of the recording material and is located in a position symmetrical with a position of the second curvature detection unit in the width direction orthogonal to a conveyance direction of the recording material.

10. The image forming apparatus according to claim 8, wherein the fixing unit includes a third temperature detecting element configured to detect a temperature outside the area of the fixing unit, and wherein the third temperature detecting element is located in a position symmetrical with a position of the second temperature detecting element in the width direction orthogonal to a conveyance direction of the recording material.

11. The image forming apparatus according to claim 10, wherein when a difference between a detected temperature of the second temperature detecting element and a detected temperature of the third temperature detecting element becomes greater than a predetermined value, the threshold temperature is set at the second threshold temperature.

* * * * *